US005263432A

United States Patent [19]

Davis

[11] Patent Number: 5,263,432

[45] Date of Patent: Nov. 23, 1993

[54] AUTOMATIC TRIM TAB CONTROL FOR POWER BOATS

[76] Inventor: Dale R. Davis, 16505 Wilderness Rd., Poway, Calif. 92064

[21] Appl. No.: 747,513

[22] Filed: Aug. 20, 1991

[51] Int. Cl.[5] ..... B63B 1/22

[52] U.S. Cl. ..... 114/286; 440/1

[58] Field of Search ..... 440/1; 114/284-287; 318/588, 648

[56] References Cited

U.S. PATENT DOCUMENTS 3,298,344 1/1967 Yunker et al. ..... 114/287

3,601,078 8/1971 Bedford, Jr. ..... 114/285

FOREIGN PATENT DOCUMENTS 20290 1/1988 Japan ..... 114/286

*Primary Examiner*—Jesûs D. Sotelo

*Attorney, Agent, or Firm*—William C. Fuess

[57] ABSTRACT

Adjustment of a power boat's trim tabs is automated throughout all phases of the operation of the boat. The boat's speed and/or the revolutions of its engine(s) are sensed and used by electronic circuits, including microprocessor-based circuits, to control prime movers, typically hydraulic pumps, in order to move the trim tabs to their optimal position. In one embodiment the boat's speed is sensed by a speedometer. Below a first predetermined speed, the boat's trim tabs are moved full down. Above a second, higher, predetermined speed the trim tabs are moved full up. In another embodiment the trim tabs are further adjusted in and about their up position, and while the boat is on-plane, so as to optimize the performance of the boat. The boat's on-plane performance is monitored by a speedometer or, preferably, by one or more tachometers. After the boat has exceeded the first predetermined speed, after the trim tabs have been initially adjusted to their full up positions, and after the speedometer or tachometer(s) is (are) continuously reading values within some small, preset, range, the trim tabs are perturbed slightly in position. The boat's throttle remains unchanged. After a settling time any effect of the changed trim tab position on the boat's performance is assessed. The trim tabs are moved in position until performance is no longer improved by further perturbations in position.

21 Claims, 6 Drawing Sheets

Present Invention

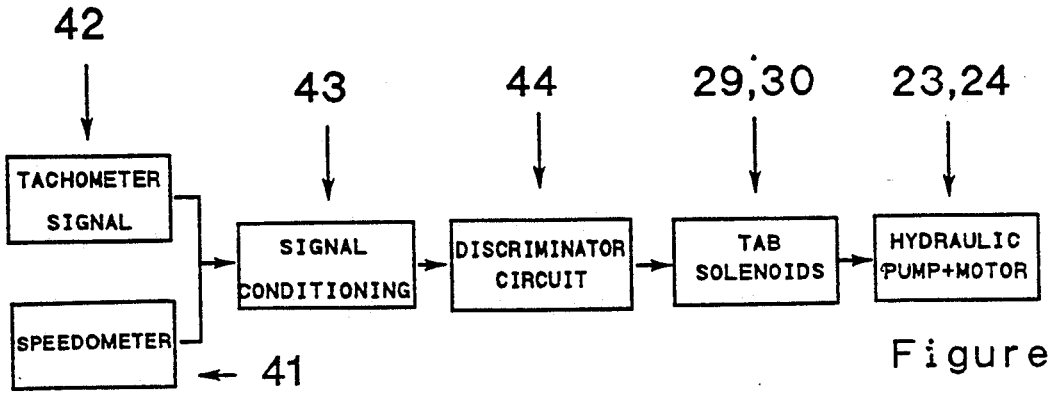
Figure 3
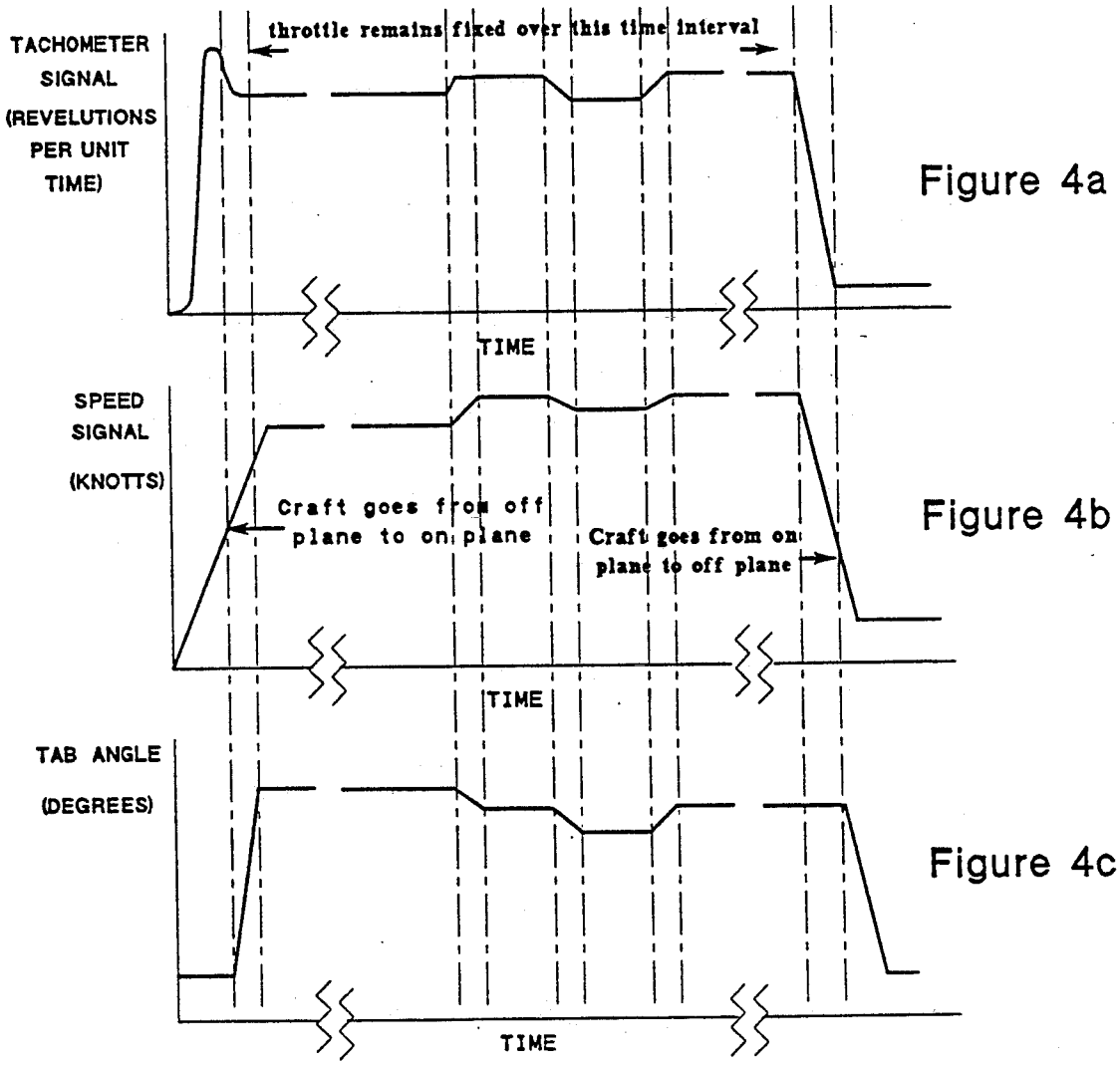
Figure 4a
Figure 4b
Figure 4c

AUTOMATIC TRIM TAB CONTROL FOR POWER BOATS

BACKGROUND OF THE INVENTION

1. Field of the Invention

The present invention generally concerns adjusting the attitude relative to level of powered marine craft, and particularly power boats, by automatic positional control of the boat's power trim tabs. The present invention particularly concerns an automated system for optimally adjusting a motor boat's power trim tabs at each of several different operational ranges of the boat so that the boat's performance, comfort and versatility may be improved.

2. Background of the Invention

2.1 The Use of Power Trim Tabs

Naval architects design, and boat builders build, large power boats of eight meters plus (8+ meters) in length so as to run bow-high. Bow-high running provides the boat with optimal positive response to its rudder, and is necessary for safety in a following sea or when running an inlet. However, a boat in a bow-high attitude appears to be, and is, running "up-hill". It undesirably suffers a laboring of its engines, a reduction in speed, and an increase in fuel consumption. The bow-high orientation of the boat's hull is often aggravated by the added weight of full fuel tanks and/or the presence of passengers in the boat's cockpit.

Trim tabs are hinged, pivoting, planar surfaces that are mounted at the aft of a motor boat near its chines. They are typically made of steel, and more typically of stainless steel. Trim tabs have been commercially available for many years. They are standard equipment on most large power boats eight (8) meters in length and larger.

Trim tabs are positioned, normally under hydraulic power, relative to the hull, and relative to the transom, of the boat on which they are mounted. Trim tabs are variable in position so as to change the attitude of the hull of a moving boat with respect to the horizontal. (Changing the position of the trim tabs has no appreciable effect on the attitude of the hull of a boat that is stationary.)

Trim tabs provide several useful functions as a result of being able to change the attitude of a moving boat's hull. These include (i) increased speed, (ii) improved fuel economy and reduced laboring of the boat's engines, (iii) improved forward visibility, (iv) reduction of pounding, listing, squatting, porpoising, and/or wake, (v) adjustment of the boat's attitude to a position that is safer or more comfortable to the boat's occupants, (vi) minimization of bow rise when the boat comes up on plane, (vii) reduction in time and energy for the boat to reach its planing speed, and/or (viii) reduction in hull stress.

Alas, these numerous benefits to the boat's operation generally accrue only when the trim tabs are in the proper position. The latitude, or range, of the proper position of the trim tabs varies from boat to boat, and from time to time. The range of "proper position" may be as critical as plus or minus two degrees (±2°). Meanwhile, trim tabs are typically variable through a range of greater than twenty degrees (20°). When the trim tabs are in a position that deviates greatly from optimal then they may actually serve to aggravate one or more operational problem conditions of the boat. Even when the trim tabs are positioned close or very close to optimal, the boat's speed and fuel economy may nonetheless be reduced a few percentage points from what the boat could achieve should its trim tabs be precisely optimally positioned plus or minus one degree (±1°).

Needless to say, the whole point of the adjustability of the trim tabs is—just as the unaltered trim of the boat itself cannot be optimal for all operational conditions—that the trim tabs should be positioned differently during different operational conditions and uses of the boat.

2.2 The Misuse of Power Trim Tabs

Alas, trim tabs are notoriously difficult for an amateur boater to correctly control. Rather than being simply another one of the many inventions and machines of man that don't work quite as well in actual practice as they are intended to do, the misuse of power trim tabs by recreational boaters is, although completely excusable, almost comical. If trim control were the sole and only task occupying the helmsman of a recreational power boat then its complexities might be mastered by the average recreational boater—at least after some time and experience. However, the interaction of proper trim control with the boat's speed, if not also with the steering of the boat through turns, makes continuously optimal trim control extremely difficult for the unpracticed, or uncoordinated, helmsman to master.

Meanwhile, most water sports like skiing, hydrosliding, disking, bonzai boarding, etc. are easier and more enjoyable if the speed of the tow boat is accurately and consistently controlled. Trimming out the vessel by manually-directed actuation of the boat's power trim tabs while the boat is coming up to a target speed distracts the helmsman and complicates the process of precision speed control. There are simply too many things for the helmsman to do—watching the water ahead, steering, glancing at the speedometer, and nudging the throttle back and forth—for him/her to devote much time to trimming the craft.

The many required tasks of watching, steering, monitoring boat's performance, controlling speed and adjusting trim often make the towing of skiers a tense experience for a tow boat's helmsman. Accordingly, one or more of the tasks are commonly performed suboptimally. The following scenario is typical for casual, recreational, users and owners of watercraft. A skier, and especially a good skier, will commonly tell a tow boat's helmsman in advance that he/she wants to ski at some predetermined speed, for example at thirty-one miles per hour (31 mph). In a few moments, the skier is ready and positioned. The skier shouts "Hit It", or makes some indication of his/her readiness to proceed.

The helmsman looks forward, and finding that all is clear, gives the boat full throttle. The boat responds by surging forward. The bow lifts and, if this motion hasn't already jerked the ski rope from the skier's hands, and if he/she makes it up on his/her skis, the helmsman maintains the throttle setting. The boat continues to accelerate. The bow of the boat often rises so high that the helmsman can no longer see the water ahead without getting out of his/her seat. Then, suddenly, the bow finally drops as the boat reaches planing speed (individual to the boat, but commonly about 20 mph) and comes up onto plane.

Because the skier wants to be towed at thirty-one miles per hour (31 mph) the helmsman commences to back off the throttle. Alas, he/she is seldom so experienced so as to be able to expediently assume the target 31 mph speed without overshooting. In the midst of this challenging mental and physical problem of control both the speed and position of the boat it is an extremely rare helmsman that is concurrently able to either (i) trim the outdrive of the boat (if the boat is of the outdrive type) and/or (ii) set the angle of the trim tabs. The average helmsman is too busy looking ahead, steering, controlling the throttle and watching the speedometer (roughly in that order of priority) so as to even attempt to trim the boat, let alone to quickly establish an optimal trim.

Typically the recreational helmsman might, for example, gingerly approach 31 mph speed and then overshoot to 35 mph. The skier, knowing that the speed attained is higher than desired and requested, may indicate, or even plead, for the helmsman to slow the boat down. Finally getting the boat's speed under control, the amateur helmsman may get around to trimming the boat. The helmsman usually does so because he/she has already learned, typically the hard way, that failing to do so reduces fuel economy by up to 25%, a matter of some economic consequence for large power boats.

Typically the very first thing that happens when the helmsman finally proceeds to trim the boat is that the boat speed increases to, for example, 34 mph in response to the trimming. Again the skier pleads for a slower speed. The helmsman regains proper speed control. By this time the helmsman is all too frequently tired and tense as he/she attempts to keep the tow speed on the mark, and to give the skier a precision tow.

Finally, it might be hypothesized that skier makes a fall. The helmsman's friends in the boat may typically cry out and tell the helmsman that the skier is down. The helmsman circles the boat to pick up the skier. In the excitement, he/she often forgets to lower the boat's trim tabs. The next time the boat is accelerated to pull out the skier, its stern digs in excessively. The skier "drinks the lake" because the boat cannot accelerate fast enough with its outdrive and/or its trim tabs trimmed up. The skier is upset because the helmsman forgot to trim down, and the helmsman is embarrassed at his or her lack of "seamanship".

The net result of this scenario is that the boat's power trim tabs—a useful feature of any large power boat which feature typically costs thousands of dollars U.S. (circa 1991)—often serve only to expose ineptitude on behalf of the boat's operator. It would accordingly be highly desirable if the positional control, and/or optimization of trim tab position, could somehow be improved, potentially by automation, during the operation of a power boat.

2.3 Automated Control of Trim Tab Position

As discussed in the immediately preceding Section 2.2, although power trim tabs provide many advantages, many recreational power boat owners find it difficult to adjust the tabs for optimal performance. As a result, many helmsmen don't use the trim tabs at all, forget to use them, or use them with less than optimal results.

One effort to solve these problems with trim tabs is shown in U.S. Pat. No. 4,749,926 to Robert J. Ontolchik [hereinafter "Ontolchik"] Ontolchik shows the use of an inclinometer to sense the attitude of a vessel. The inclination data so derived is used in a feedback servo loop to position the vessel's power trim tabs so that the vessel will be held to a particular angle of inclination both fore to aft and port to starboard. Ontolchik does not attempt to position the vessel's trim tabs for optimal hull thrust, nor for maximum fuel efficiency. The system of Ontolchik also has the disadvantage of requiring a costly and complex analog Hall effect inclinometer.

U.S Pat. No. 3,777,694 to Donald Edward Best [hereinafter "Best"] shows a similar method to that of Ontolchik. Best shows the sensing of a boat's attitude by a disc and photocells so as to control the boat's power trim tabs; thereby to adjust the attitude to the vessel to a predetermined angle. The result is basically the same as in the Ontolchik patent.

While other patents on trimming boats exist in the patent literature, these are the only two patents known to the inventor that address the trimming (or adjustment) of a boat's power trim tabs. Numerous other patents address the trimming of the outdrives of power boats, the trimming of steering devices and the trimming (adjustment) of mechanisms of the boat other than its trim tabs.

As of the date of the present application, the inventor knows of no commercially available trim tabs which automatically adjust to the proper position during different operational phases of the boat's usage.

2.4 What Function(s) Would Desirably Be Realized By Automated Positional Control of a Power Boat's Power Trim Tabs?

As was discussed in the immediately preceding sections 2.1 through 2.3, the required control of a power boat's trim tabs may be, at times and from time to time, complex. Nonetheless to this control complexity, existing automated power trim tab control systems simply cause a boat to assume, and to hold, a particular attitude both fore to aft and port to starboard. More, and more sophisticated, trim control than simply attitudinal-position-holding is desired.

Most marine vessels are designed so that when they are at rest in the water, the deck lies at a small angle (2–4 degrees) from the horizontal with the bow slightly higher than the stern. On power craft with planing hulls, the boat will lift out of the water as the boat gains speed. If the drive system of the boat is located under and slightly behind its center of mass, the boat will rise almost vertically out of the water and the helmsman will maintain good visibility of the water ahead. However, if the center of mass of the craft is well astern of the center of the hull, then the bow will typically rise from five to thirty degrees (5°–30°) out of the water as the boat comes up on plane.

A boat with extreme bow rise obstructs the helmsman's visibility of the water ahead as the boat comes up on plane. As the boat gains speed, more and more of its bow comes out of the water until the center of gravity of the boat begins to break out of the water. At this point the boat's hull falls to its full on-plane condition. The on-plane boat typically rides from two to eight degrees (2°–8°) from the horizontal. The precise angle the boat assumes is dependent upon the magnitude and distribution of its load, and on its hull design.

A given hull design begins to plane at a fixed speed. When the boat slows down it will go off-plane at a slightly lower speed than the speed it went on plane. Therefore, automatic trimming devices should take this hysteresis into account when implementing the automatic trimming devices. There is always an "off-plane to on-plane" speed and a slightly slower "on-plane to off-plane" speed.

The present manufacturers of manually controlled power trim tabs recommend the following procedures for the proper adjustment of the trim tabs.

First, if a boat is off-plane, the trim tabs should be in their full down position. This aids both in keeping the boat's bow rise low and in optimizing the forward thrust of the boat.

Second, when the boat reaches planing speed, and the boat has fallen onto plane, the tabs should be raised to their full up position. If this is not done, many boats will assume a "bow steering" condition. Bow steering occurs when the center of rotation of the boat is to the fore of the boat's center line. Steering becomes difficult as the boat tends to float away from the desired steering line. Bow steering is often, but not always, characterized by the bow of the boat riding lower than the stern. In addition to avoiding bow steering, trimming the tabs to an up position will reduce energy-consuming drag.

For many vessels, trimming the tabs full up will leave the craft in its optimal position for fuel economy and ride. However, for others, and especially for larger watercraft, the optimal position for best fuel economy is somewhat lower than the full up position. To find the optimal "on plane" position, power trim tab manufacturers recommend that the helmsman should first move the trim tabs to their full up position. Then, while watching the tachometer(s), the helmsman should incrementally position the trim tabs downward. (Many larger vessels are equipped with dual engines, and dual tachometers.) When the tachometer's (tachometers,) reading(s) is (are) maximized for a fixed throttle setting, then the trim tabs are at their optimal position for fuel economy.

When the boat goes back off-plane due to the slowing of the craft, the trim tabs should again be moved to their full down position.

All of these moves require the helmsman to remember both when and how to move the trim tabs. The precise present positions of the tabs is commonly unknown, and the direction and amount by which the trim tabs should be moved to trim the boat, is often not known or has been forgotten by many operators.

Because large boats, or yachts, consume fuel, typically derived from scarce petroleum, at a large and costly rates, it would be useful to implement a method for electronically controlling boat's power trim tabs in order to improve the fuel economy of the boat.

SUMMARY OF THE INVENTION

The present invention contemplates automating the adjustment of a power boat's trim tabs throughout all phases of the operation of the boat. To this end, the boat's hull speed, and preferably also the revolutions of its engine(s), are sensed. This information is used to trigger electronic circuits which control prime movers, typically hydraulic pumps, in order to move the trim tabs to their optimal position.

In a first, rudimentary and simplified, embodiment of the present invention only the boat's speed through the water is sensed by a speedometer. Below a first predetermined speed, the boat's trim tabs are moved full down. Above a second, higher, predetermined speed the tabs are moved full up. Two speeds—a first and a second—are needed in order to control the trim tabs for planing hysteresis, meaning the tendency of a vessel to come on-plane at a slightly higher speed than it goes off-plane.

In a second, more sophisticated, embodiment of the invention the trim tabs are further adjusted in and about their up position, and while the boat is on-plane, so as to optimize the performance of the boat. The boat's on-plane performance may be monitored by the speedometer or, as is preferable, by a more exacting determination that is derived from monitoring the revolutions per unit time of the boat's engine(s) with one or more tachometers.

In the preferred second embodiment one or more tachometers which indicate the revolutions the boat's engine(s), as well as the speedometer indicating the boat's speed through the water, are simultaneously monitored. In dual drive boats a tachometer for each of the boat's two engines are monitored. The information derived is processed in an electrical control circuit, typically a microprocessor that runs a firmware program.

After the boat has reached the first predetermined speed, and after the trim tabs have been initially adjusted to their full up positions, the microprocessor proceeds to monitor the tachometer(s). After the microprocessor determines that the tachometer(s) is (are) continuously reading values within some small, preset, range during a predetermined period of time, it generates a signal. This signal activates appropriate relays so as to gate a source of motive power, normally hydraulic pressure, to move the trim tabs—which trim tabs were recently previously moved full up—slightly downwards in position. This movement is preferably accomplished by first turning on hydraulic relays for a predetermined short period of time, and by then turning the same relays off again.

Next, the microprocessor again allows the entire system to settle for several seconds while the minor adjustment in trim tab position comes to affect the attitude of the boat's hull. Depending upon the particular shape and size of the boat's hull this settling period can take upwards of a minute or more. During this time the microprocessor continuously monitors the tachometer(s) (preferably, or, alternatively, the speedometer) for stability. The throttle setting of the engine(s) remains fixed (or else, any change in the throttle being manually effected, the settling process starts anew).

When the monitored revolutions (or speed) become stable then the newly sensed values are compared with previous values as an indication as to whether the performance of the engine(s) has improved, or has diminished. The engine(s) performance provides a corresponding indication of the performance of the boat over the water.

Over-the-water performance sensing continues for several cycles of adjusting the boat's trim tabs. Changes in the sensed revolutions per unit time are indicative of changes in the boat's speed. Higher revolutions, and a higher speed, at a fixed throttle setting are a direct measure of improved fuel efficiency. The improvement in a power boat's fuel efficiency realized by the automatic trim tab adjustment in accordance with the present invention is one of the major benefits of the invention.

According to the preferred process of the invention, the boat's trim tabs are optimized in position first by reference to changes in the tachometer(s) readings. Only if the tachometer readings are unavailable, or inconsistent, are the trim tabs optimized in position by an alternative reference to changes in the boat's speed. The throttle setting(s) of the boat's engine(s) remain constant throughout the monitoring and assessment. When each tachometer reads within a predetermined range for a predetermined period of time, the microprocessor directs another adjustment to the trim tab position.

The optimal trim tab position is determined when trimming the tabs no longer causes the tachometer's(s') reading(s) to increase. At this time the optimal trim tab position is determined as the previous trim tab position.

After the initial, full-up, on-plane adjustment, the optimal trim tab adjustment can be approached by successive approximations, converging on the optimal adjustment from both the too-far-up and too-far-down directions. However, it has been found that, on some boats, the relatively larger swings of the initial approximations may be sensed by the boat's helmsman, and may prove disconcerting. Accordingly, it is preferred in the present invention that the trim tabs should be positioned successively downwards (from their initial full up position) or successively upwards (from an initial position downward of the ultimate, optimal, position) in a series of small, unidirectional, increments. Although this manner of adjustment may take slightly more time, and/or slightly more adjustment cycles, than an alternative, mathematically time- and/or positionally-optimized, strategy of successive adjustments, the goal of the present invention to optimally trim a power boat must always be tempered by the desires and sensitivities of the boat's owner, helmsman, and/or occupants.

According to the preferred method of the present invention where the trim tabs are always adjusted downwards (from their full up position) (or upwards from a position downwards of optimal) in small increments until the tachometer(s) reading(s) decrease, the very last adjustment to the trim tabs is to move them incrementally up (down) in position. At this time the efficiency, and fuel efficiency, of the boat is substantially optimized.

The automated trim tab adjustment system of the present invention will at any time release control of the trim tabs to the manual control of the helmsman. After optimization is concluded the helmsman is preferably immediately, and automatically, accorded full manual control of the trim tabs. In this manner trim tab control is in the helmsman, and is no longer in the automated system, should he/she wish to further, manually, vary the attitude of the boat by use of the power trim tabs.

Still further automated adjustments of the trim tabs, such as a relative adjustment between the port and starboard trim tabs based on inclinometer information as is taught by Ontolchik (referenced in the Background of the Invention section of this specification), are fully compatible with the method and apparatus of the present invention.

Accordingly, the present invention will be recognized to be embodied in an automated system for controlling the position of the trim tabs of a vessel. In one of its rudimentary embodiments such a system includes a speedometer for sensing the speed of the vessel through the water and a control circuit responsive to the sensed speed for positioning the vessel's trim tabs to an up position at such times as the sensed speed increases above a first predetermined value. The control means desirably further positions the vessel's trim tabs to a down position at such times as the sensed speed decreases below a second predetermined value, less than the first predetermined value. Attainment of the first predetermined value normally represents a time and a speed at which the vessel is on-plane; attainment of the second predetermined value normally represents a time and a speed at which the vessel goes off-plane. Although the vessel is typically self-powered in the form of a boat, the automated trim tab control works equally well for any planing hull such as seaplanes and surface effect craft having positionable trim tabs.

In a further, more comprehensive, embodiment, the automated trim tab control system of the present invention is particularly for use on a power boat. In such an embodiment the system includes a monitor of the performance of the boat, preferably a tachometer that senses the revolutions (or the revolutions per unit time) of the power boat's engine. The control circuit of the second embodiment includes a perturbation generator, operative at a time after the trim tabs have been positioned to the up position, which is controllable for, from time to time, slightly varying the trim tabs upwards or downwards, as the case may be, in position about their current position. Finally, the control circuit includes a comparison means that is responsive to the trim tab positional variations of the perturbation means, and also to the sensed revolutions per unit time of the tachometer means, for controlling the perturbation means to vary the trim tab position upwards or downwards, as the case may be, in order that the sensed revolutions per unit time should be maximized.

These and other aspects and attributes of the present invention will become increasingly clear upon reference to the following drawings and accompanying specification.

BRIEF DESCRIPTION OF THE DRAWINGS

FIG. 3 is a schematic block diagram showing the electrical and mechanical components of an automated trim tab control system in accordance with the present invention.

FIG. 4, consisting of FIG. 4*a* through FIG. 4*c*, is a graph showing the changes over time of each of a power boat's engine r.p.m., water speed in knots, and power trim tab angle during operation of the automated trim tab control system in accordance with the present invention.

DESCRIPTION OF THE PREFERRED EMBODIMENT

The present invention is embodied in an automated trim tab control system for power boats, and in the automated trim tab control method implemented by such a system. The system and method of the invention are directed to trimming the power trim tabs of a power boat for all the reasons that trim tabs may desirably be positioned, and particularly for maximum fuel economy at the boat's current throttle setting.

The trim tab control method of the present invention is compatible with various power trim tabs as are manufactured by various manufacturers. An electrical control circuit within the system of the present invention simply controls certain solenoids that gate motive power to each of the two, port and starboard, power trim tabs of a power boat in order to position such tabs upwards or downwards. The gated motive power is typically hydraulic power. However, the motive power may, alternatively and with a generally improved precision, be electrically-generated force delivered through a non-hydraulic linkage such as a rack and pinion. Insofar as it results in the selective actuation and control of solenoids, and the resultant positioning of the boat's trim tabs, the automated method of the present invention is equivalent to previous systems for manually-directed powered positioning of a boat's trim tabs.

The method of the present invention commences by placing both trim tabs in their full down positions when the boat is below planing speed. When planing speed is achieved then both trim tabs are brought in tandem to their full up positions. After such lapse of time as permits that both trim tabs are clearly in the full up positions, a next step of the invention is to control the boat's throttle to remain in a fixed position, monitor an engine tachometer, and incrementally position the tabs downwards but a small amount from their full up positions. If the tachometer reading increases at the fixed throttle setting then this indicates that the minor repositioning of the trim tabs has placed the boat in a more efficient operational state. Commensurate with the detected increase in engine revolutions per unit time, the boat's speed will also increase at the fixed throttle setting.

If, conversely, the tachometer-indicated engine revolutions per unit time show a decrease, then the boat is operating less efficiently. In this case the boat's trim tabs may be incrementally raised up. A search both upwards and downwards in the setting of the trim tabs may be continued so long as is necessary or desired by simply holding the throttle fixed and continuing the process of successively adjusting the trim tab positions. The successive adjustments are normally continued until a change in either direction from the current position results in a decrease in the tachometer-sensed engine revolutions per unit time.

Figure 1A:
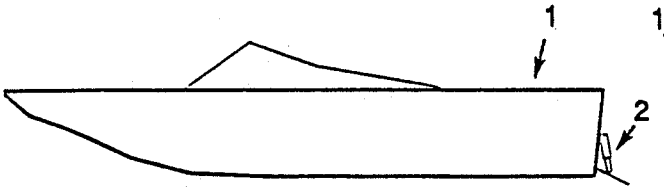
Figure 1a Prior Art
FIG. 1, consisting of FIG. 1*a* and FIG. 1*b*, is a diagrammatic representation of a prior art boat showing the typical location of typical power trim tabs on a typical power boat.
Figure 1B:
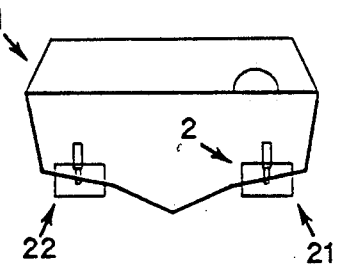
Figure 1b Prior Art

A prior art power boat 1 mounting a prior art power trim tab system 2 having a starboard trim tab 21 and a port trim tab 22 external to the boat 1 is shown in FIG. 1. In such prior art power trim tab system 1 a human operator (not shown) of the boat commands the position of the trim tabs 21, 22.

Figure 2A:
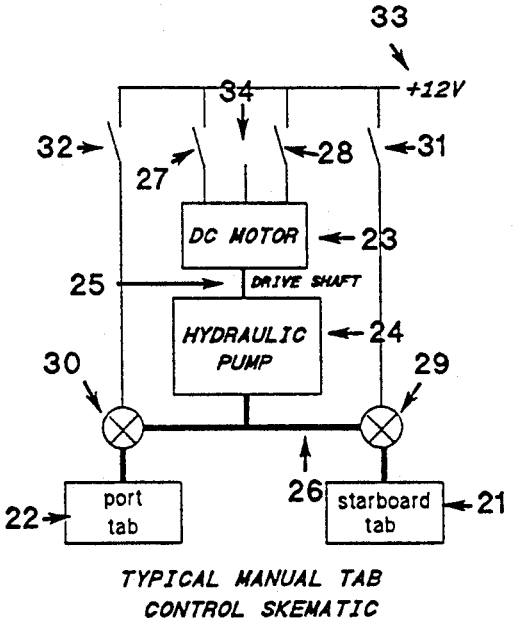
Figure 2a Prior Art
FIG. 2*a* is an electrical and mechanical schematic diagram of a typical prior art electrical and hydraulic system for the powered control of a boat's trim tabs.
Figure 2B:
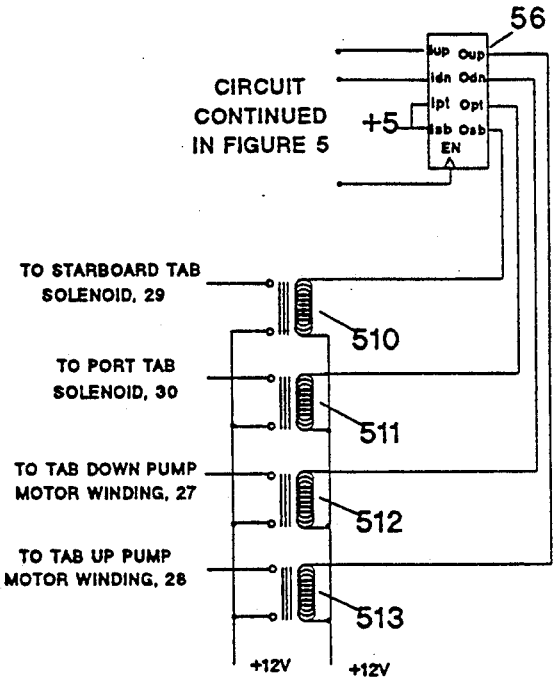
FIG. 2*b* is an electrical schematic diagram of a part of the automated trim tab control system in accordance with the present invention, this part and this FIG. 2*b* being particularly directed to showing how the circuit of the present invention, an exemplar of which circuit will be shown in FIG. 5, may interface to an existing, prior art, power trim tab system.

An electrical and mechanical schematic diagram of a typical prior art electrical and hydraulic power trim tab system 2 for the powered control of a boat's trim tabs 21, 22 is shown in FIG. 2. A bidirectional DC MOTOR 23 connected between 12 V.D.C boat's power source 33 and ground 34 drives a HYDRAULIC PUMP 24 through a DRIVE SHAFT 25 to selectively produce a positive hydraulic pressure in the hydraulic lines 26 dependent upon whether an "up" switch 27, or a "down" switch 28, is manually closed. The switches 27, 28 are normally configured as a double pole double throw (DPDT) switch where one only of the "up" or the "down" positions is selectable at any one time.

Continuing in FIG. 2, whatsoever hydraulic pressure presently exists in the hydraulic lines 26 is independently gated to the starboard trim tab 21 or the port trim tab 22 by a respective actuation of normally-closed (NC) starboard solenoid 29 or normally-closed (NC) port solenoid 30. The starboard solenoid 29 and the port solenoid 30 are respectively independently enabled by being gated to the boat's 12 V.D.C power source 33 respectively through manually-controlled starboard on-off switch 31 or port on-off switch 32.

The resultant operation of the prior art manual trim tab control system shown in FIGS. 1 and 2 permits a human operator of the boat to control, via switch actuation, the positioning and repositioning of both the starboard trim tab 21 and the port trim tab 22.

An electrical and mechanical schematic block diagram of the automated electrical and hydraulic system in accordance with the present invention for the powered control of a boat's trim tabs is shown in FIG. 3. A SPEEDOMETER 41 develops a speed signal representative of the instantaneous speed of the boat through the water. Preferably also a TACHOMETER 42 develops a signal(s) representing the revolutions, or the revolutions per unit time, of each of the boat's engines. The speed and revolutions per unit time signals are received and conditioned in SIGNAL CONDITIONING circuit 43. The conditioned signals are then sent to a decision making circuit in the form of DISCRIMINATOR CIRCUIT. Dependent upon speed and/or engine revolutions as will be discussed, the same TAB SOLENOIDS 29, 30 previously seen in FIG. 2 are activated to switch the HYDRAULIC PUMP AND MOTOR 23, 24, also previously seen in FIG. 2, on and off.

The manner in which sensed speed and revolutions per unit time are used to control the trim tab positions is illustrated in the related graphs of FIGS. **4*a* through 4*c*, which Figures share a common time line. Below a preset "off-plane" speed, the TRIM TABS 21, 22 (shown in FIGS. 1 and 2) are moved full down by turning both TAB SOLENOIDS 29, 30 (shown in FIGS. 2 and 3) on for a time slightly longer than is required to move them from their full up to their full down position. At another preset, "on-plane", speed, the TRIM TABS 21, 22 are moved to their full up position. This is accomplished by turning on TAB SOLENOIDS 29, 30 for a time slightly longer than is required to move the TRIM TABS 21, 22** from their full down to their full up position.

With the boat's throttle (not shown) in a fixed position, the tachometer signal from TACHOMETER 42 (shown in FIG. 3) is then allowed to stabilize for a time T1 (not shown in FIG. 4; a time interval less than the shortest interval between successive readjustments of the trim tab angle as are shown in FIG. 4c). At the end time T1, the tachometer signal is averaged for T2 seconds (not shown in FIG. 4; a time interval necessarily less than T1 and normally only a small integer number of seconds). Next the TRIM TABS 21, 22 are incremented slightly downwards by turning on the TAB SOLENOIDS 29, 30 for a few hundred milliseconds during the presence of an appropriate hydraulic force from HYDRAULIC PUMP AND MOTOR 23, 24 (shown in FIGS. 2 and 3).

The tachometer signal is again allowed to stabilize for T1 seconds. It is then read again for T2 seconds. If the most recent reading of TACHOMETER 42 is greater than the previous tachometer reading, then the TRIM TABS 21, 22 are again incremented downward in position and the process is repeated until the current reading is equal to or less than the previous reading. At this time the tabs are incremented up to their previous positions.

At this point the automated trim tab control system in accordance with the present invention can be made to function in either of two ways. First the system can continue to search for the optimal trim setting. Optionally, and alternatively, the system can release automatic control so that the helmsman can manually adjust the attitude of the vessel to his personal preference, fore to aft and port to starboard. It is unlikely the helmsman will choose to adjust the attitude to the vessel fore to aft at this point. However if the vessel lists to one side, it is probable that he/she will adjust the attitude port to starboard.

Figure 5:
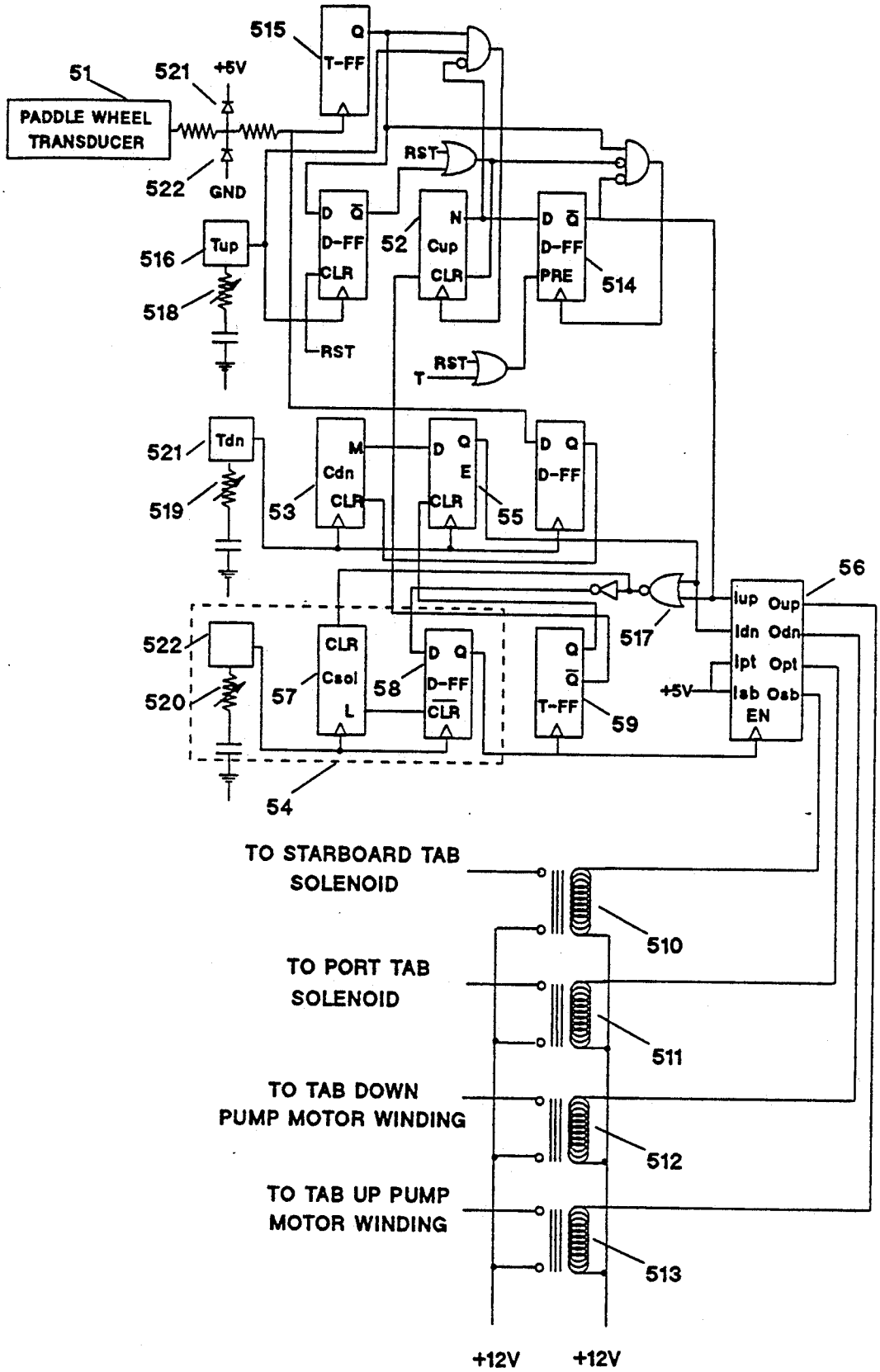
FIG. 5 is a schematic diagram showing a first embodiment of a circuit, based on discrete electrical components, that comprises the electrical portion of the automated trim tab control system in accordance with the present invention, which system was previously seen in the block diagram of FIG. 3.

The control circuit of the automated trim tab control system in accordance with the present invention can be implemented with or without the use of a microprocessor—as is demonstrated in FIGS. 5 though 7.

A first embodiment of the control circuit of the automatic trim tab control system, which embodiment is implemented with discrete components, is shown in FIG. 5. While there are many ways this control circuit can be implemented without the use of a microprocessor (which microprocessor-based embodiments will be shown in the second and third embodiments of FIGS. 6 and 7), the particular, and arbitrary, discrete embodiment of FIG. 5 is first described, and then alternative discrete circuits for accomplishing the same task are further discussed.

Referring now to FIG. 5, the purpose of the circuit is to sense the speed of a boat by using a signal generated from a paddle wheel speed transducer, 51 which activates solenoids, 510, 511, 512, and 513 conditionally based upon the sensed speed data. The discrete circuit performs this function by measuring the time between the pulses generated by the paddle wheel. (An example of a suitable paddle wheel transducer is the AIRMAR Model S21. This transducer has permanent magnets mounted in each vane of the paddle wheel. Paddle wheel speed transducers typically have 4 paddles. Hall effect devices are mounted such that the magnets pass in close proximity when the wheel rotates. Thus, each time a magnet passes the Hall effect material, a voltage pulse is generated which can then be conditioned and used to drive the logic.) Both the frequency and magnitude of the Hall effect signal increase as the rpm of the paddle increases. Therefore the signal is clipped to logic levels. The circuit accomplishes that with the clamp diodes 521 and 522 tied between 5 V.D.C. and ground. When the paddle wheel rotates below a critical speed then insufficient voltage is generated to drive logic levels. Provision is made in the circuit to prevent this start-up condition from generating erroneous signals. The pulses reset two counters each time the paddle wheel magnet passes by a Hall effect device. One of the counters, counter 52, senses when the boat is on plane. The other, counter 53, senses when the boat is off plane. A third timer circuit, timer circuit 54, is used to time how long the up and down trim tab solenoids are turned on.

Adjustment potentiometers 518, 519, and 520 permit the changing of an RC circuit which controls the pulse rate of the timer chips 516, 521, and 522. Thus the on and off plane speed settings can be adjusted, and the time the trim tabs are left in the active up or active down modes is commensurately adjusted.

To avoid undo complication, certain parts of the circuit are not shown. A power supply circuit and a reset circuit, commonly known in the art, are left off the schematic. An optional power on/off switch is also not shown.

Small boats go onto plane at about 20 miles per hour, and go off plane at about 16 miles per hour. While some larger vessels may go on and off plane at lower speeds, 16 and 20 miles per hour will be used in the following, exemplary, functional explanation.

Normally, the system of the present invention will be switched on when the craft is still at rest in the water. When this happens, the down counter 53 will run free. The paddle wheel is calibrated so that it will reset the counter at a specific count when running less than 20 miles per hour. In this example, the counter will just reach 20 miles per hour when the count reaches M. Thus if the counter counts to M or beyond then the boat is traveling 20 miles per hour or less.

Note that the M output of the counter, 53 is connected to the D port of a latch 55. At power on, the input to latch 55 is enabled through the use of a PRESET signal. Latch 55 is conveniently a type which has an input enable pin. In this case when E is a logic high, the input is disabled. Thus, when the M output of the counter goes high the latch input is disabled on the next clock cycle when the Q output of 55 goes high. Thus a high is latched into 55 until it is cleared. At an appropriate time, to be described later, the latch will be reset with a high signal sent to the clear pin of the latch.

The high output at Q sets several ports. It places the trim down port of the solenoid driver chip 56 active. It starts the solenoid counter 57, it provides a high to a D-flip flop 58 and it enables the solenoid driver chip 56. When the solenoid driver chip 56 is enabled this causes the down tab solenoid 512, the port tab solenoid 511, and the starboard tab solenoid 510 to turned on. The solenoids remain on, driving the port and starboard tabs down, until the solenoid driver chip 56 is disabled.

The counter 57 clears flip-flop 58 when it reaches a count of L, thus disabling the solenoid driver chip 56 and turning all the tab solenoids off. Thus the downward signal to the trim tabs is removed. When the flip flop 58 clears it also clocks the toggle flip flop 59. This causes the D flip flop 55 to become inactive and forces the D flip flop 514 active.

Thus the circuit is set up to watch for a speed condition when the craft goes on to plane. The up circuit (which moves the tabs up when to boat is on plane,) functions much like the previous down circuit. There are, however, certain exceptions. In this case the circuit must sense when the paddle wheel 51 resets the counter 52 before the count has reached N. That is to say, action must be taken by the circuit when a logic low is sensed at the output of counter 52. There are states when the counter can indicate zeros while the boat is moving at off plane speeds. These logic states are removed by the additional logic in the up circuit. For example, if the circuit is initialized when the paddle wheel signal is part way through its cycle, the circuit could sense a logic low, indicating the craft was on plane, and could thus send a false signal to raise the tabs. To prevent this from occurring the output of the timer is only read by the D flip flop 514 when the paddle wheel output is in that part of it's cycle when the toggle flip flop 515 is high, when the counter 52 is active, and when the Q output of the D flip flop 514 is high.

Synchronization is completed by controlling the clocking of counter 52. The 52 counter is clocked only if the counter output N is low and if there is a high from both the up timer 516 and the toggle flip flop 515.

Summarizing the up circuit, the counter 52 measures the number of counts between paddle wheel pulses 51. If the count is less than a number N the counter 52 will output a low to D flip flop 514. This logic low signal produces a latched output to flip-flop 514. That output then drives the solenoid timer circuit 54 and the solenoid driver chip 56 through the same or gate, or gate 517, as was used for the down circuit. Thus, from here on the circuit components are the same as used for the down circuit. The tabs are raised by the enabling of the solenoid driver chip 56 and are turned off by the disabling of the solenoid driver chip 56. When the D flip-flop disables the solenoid driver chip 56 then it again toggles the T flip-flop 59, activating the down circuit and deactivating the up circuit.

There are several alternative ways the circuit of the present invention based on discrete components can alternatively be implemented. Crystals can replace all the timers. In this case the counters are set up to detect key counts which indicate the passing of on and off plane speeds, and how long the solenoid timer had been on.

The speed transducer can just as well be a pressure transducer. In this case the circuit design would use analog comparators to sense when the speed had reached the key set points. The solenoid timer circuit could be used in the configuration described in detail above.

The speed transduced from a pressure transducer can also be received into an analog to digital converter, or ADC. Digital numbers can then be used with the basic circuit that is described in detail above.

The circuit of the present invention need not drive a tab positioning system that uses a hydraulic actuating force. In fact, there are advantages to controlling tabs with a rack- and pinion-based system. Rack and pinion tab control systems have less variation in their internal friction than do hydraulic systems, and respond much more rapidly to control inputs. Thus they are easier systems to operate under servo control.

All the components used in the electrical control circuit embodiments of the present invention are commonly available from various manufacturers as standard components.

Extending the concept of the present invention to dual engine (typically also dual prop) boats is straightforward. However, in dual engine craft, the process for adjusting the tabs is slightly different. First the RPM of the two engines is synchronized. This can be done similarly to the method used by Glenndinning Marine Products, Inc. Conway, S.C., U.S.A.

The same electronic control circuit has two duplicate tachometers feeding onto the same bus. The processor keeps track of inputs from both tachometers by multiplexing between them. The output circuitry for a twin engine power boat is the same as for single engine craft since there are still only port and starboard trim tabs.

Figure 6:
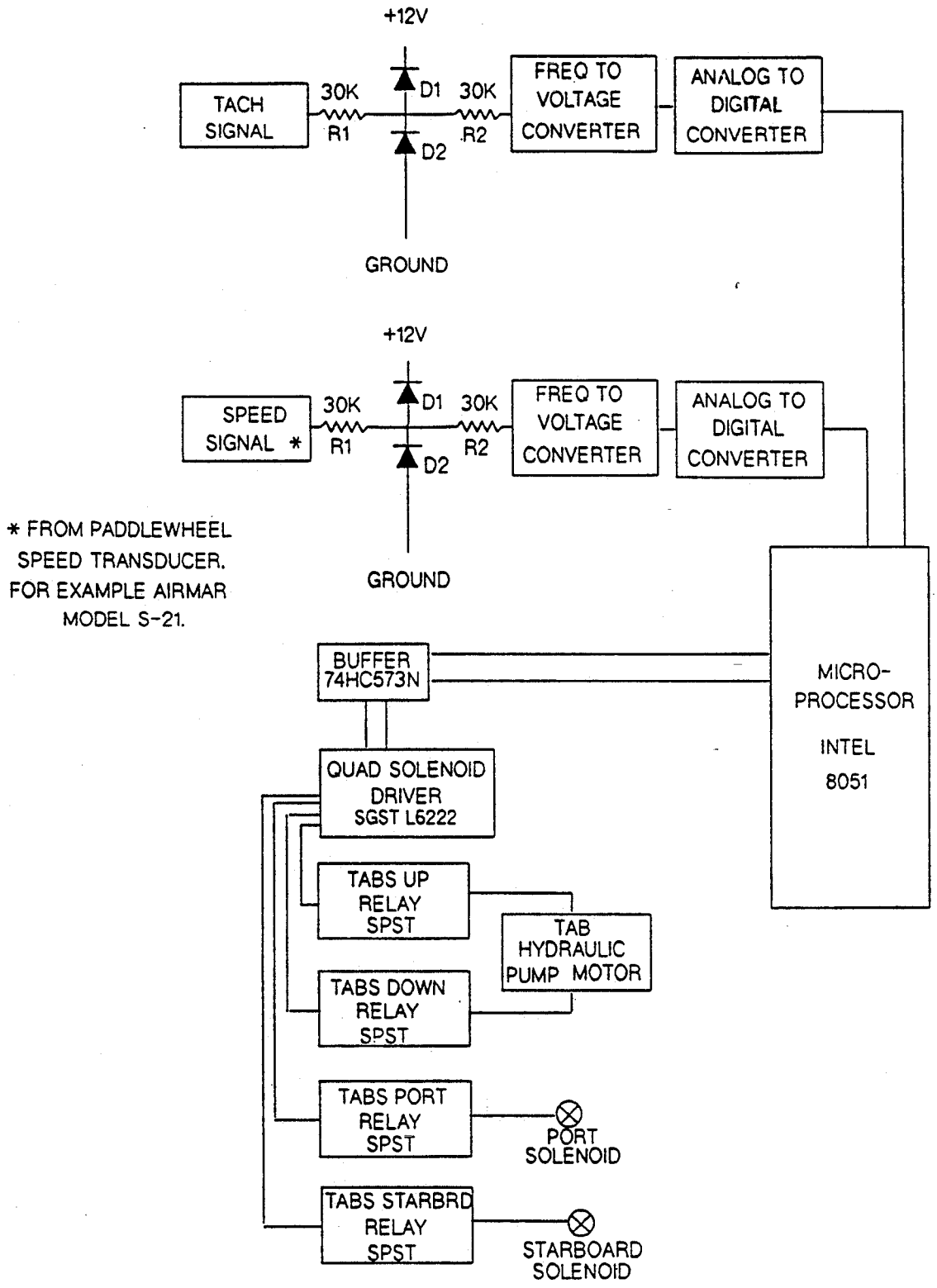
FIG. 6 is a schematic diagram of a microprocessor-based, second, embodiment of the circuit that comprises the electrical portion of the automated trim tab control system in accordance with the present invention, which system was previously seen in the block diagram of FIG. 3.
Figure 7:
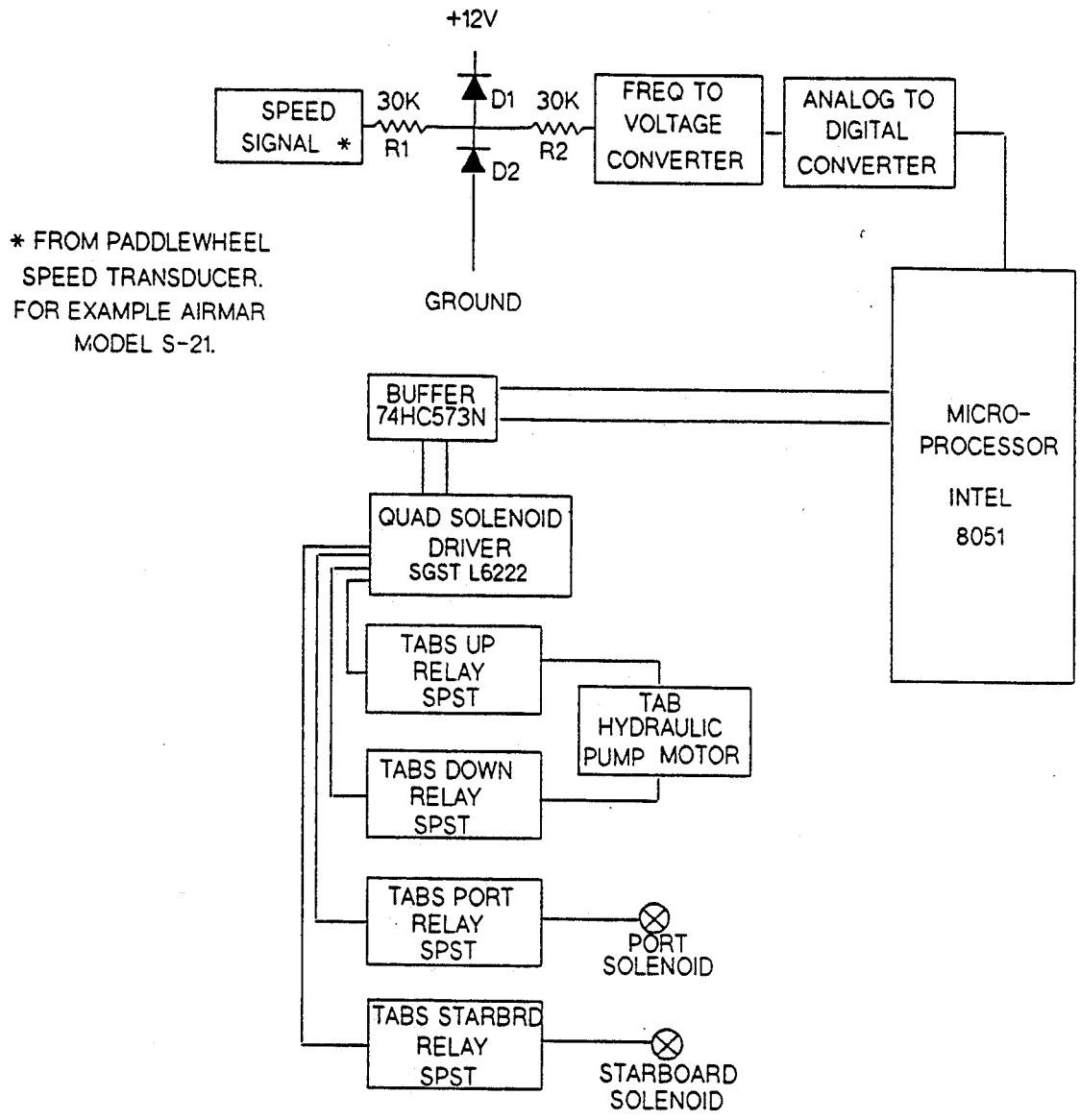
FIG. 7 is a schematic diagram of a simplified, microprocessor-based, third embodiment of the circuit—particularly for use on boats for which the full up tab position is optimal when the boat is on-plane—that comprises the electrical portion of the automated trim tab control system in accordance with the present invention, which system was previously seen in the block diagram of FIG. 3.
Figure 8:
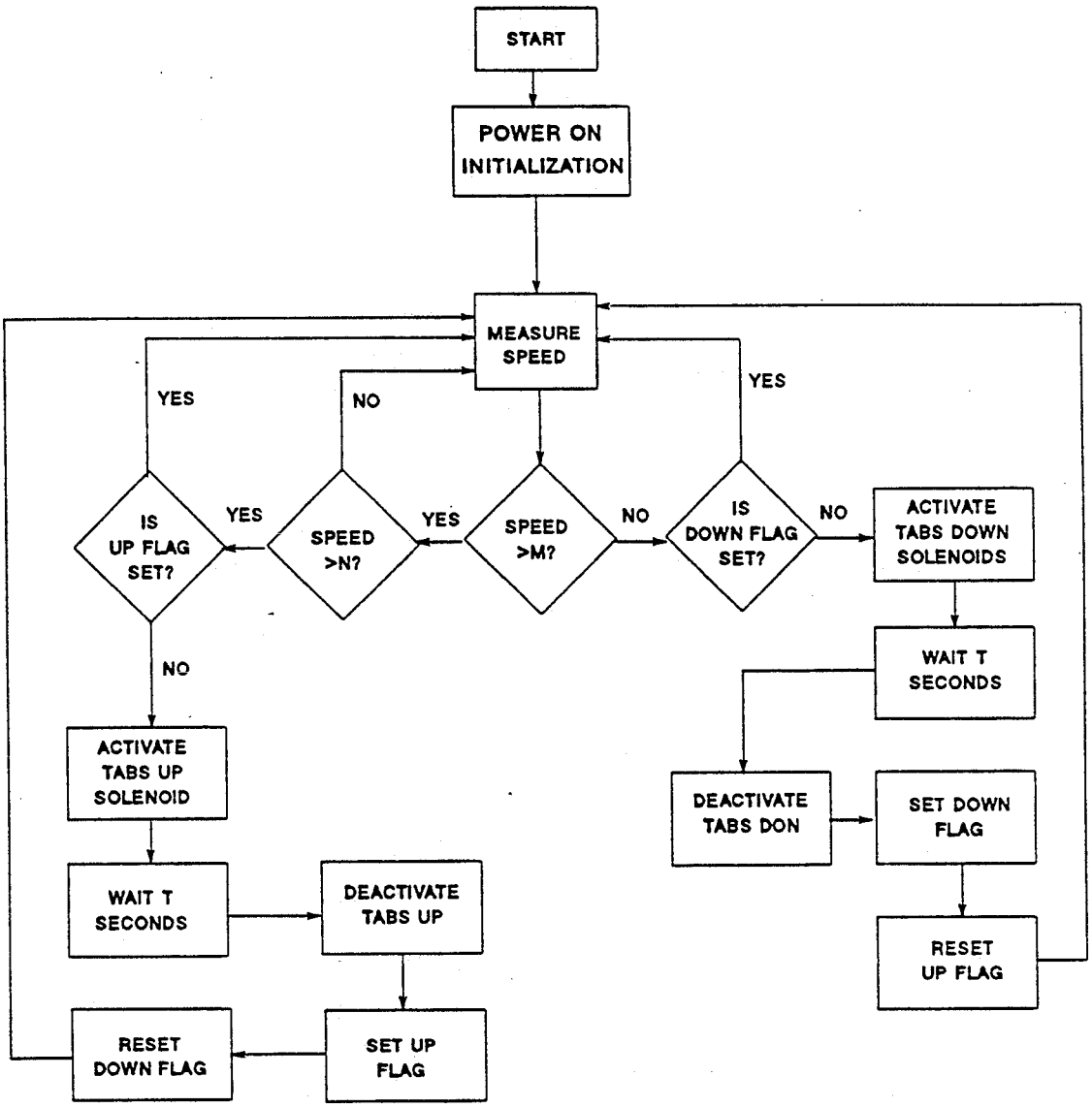
FIG. 8 is a flow chart of a firmware program implemented by the microprocessor in the first embodiment circuit of the present invention, previously seen in FIG. 5, in performance of automated trim tab control.

Two embodiments of the electrical control circuit of the automated trim tab control system of the present invention, which embodiments are based on microprocessors, are shown in FIGS. 6 and 7. A microprocessor-based second embodiment of the control circuit that is shown in FIG. 6 senses both the rpm's of the boat's engines and the boat's speed. A microprocessor-based third embodiment of the control circuit that is shown in FIG. 7 is particularly for use on boats for which the full up tab position is optimal when the boat is on-plane, and senses only the boat's speed. FIG. 8 is a flow chart of a firmware program implemented by the microprocessor in the third embodiment circuit of FIG. 7.

In embodiment of FIG. 6 two tachometer circuits and one speed sensing circuit provide input to a microprocessor. The microprocessor is programmed to adjust the tabs full down when below planning speed. When planing speed is reached, the tabs are again moved full up. One of the tachometer signals is chosen as a master signal, the other as a slave signal. The one of the signals is averaged by the microprocessor until it has reached a stable condition. While any criterion can be used to define "stable", in the current embodiment the tachometer is considered stable if it is changing less than 50 RPM per sample period. With the master throttle fixed, the slave throttle is servoed (adjusted) with an actuator module. This unit mechanically moves the throttle. This is done until the slave tachometer RPM matches the master tachometer RPM within the predetermined criterion. At this point, both throttles are fixed. Next the tabs are incremented down by a small amount. The engines RPM's are again measured as in a single engine craft. Tab position is searched until engine RPM's are maximized.

The circuit of FIG. 7, operating under the firmware control flow-charted in FIG. 8, operates commensurately save that the boat's speed, and not engine's(s') RPM's, are the criteria by which the optimal position of the boat's trim tabs is assessed.

Under automatic speed control of the power boat, such as the selfsame inventor of the present invention has described in his pending patent application U.S. Ser. No. 07/231,761 filed Aug. 12, 1988, for POWER BOAT SPEED, ACCELERATION, AND TRIM CONTROL (the contents of which are incorporated herein by reference), speed control is temporarily released after a desired, preset, speed is achieved in order to make successive trim tab adjustments in accordance with the present invention. Between each trim tab adjustment, speed control would again be established and the boat's speed again adjusted to the desired, preset, speed before a next tab adjustment is made.

The system and method of the present invention completely automates during all operational conditions of a power boat that trim tab control which was previously accomplished either manually or, if in an automated fashion, in a different manner for different purposes than the manner and purpose of the present invention. Boat dealers, boat manufacturers, and owners of large vessels (25 feet long and up) alike generally ascribe trim control to be difficult to accomplish. Indeed, many recreational boaters find manual trim tab control entirely too difficult to implement at all, and totally fail to adjust their boat's power trim tabs. The present invention completely overcomes these difficulties.

The modest expense of the system and method of the present invention for automating the task of trimming power boats is justified not only by the optimal continuous realization of the many benefits of a properly trimmed boat, but by the increased owner/operator satisfaction and pleasure accruing thereby. Indeed, the expense of the automated trim tab control system in accordance with the present invention is believed justified on most boats by the fuel savings alone that are achieved by use of the system.

Accordingly, the system and method of the present invention automatically and dynamically adjusts a boat's trim tabs to achieve maximum forward thrust coming up onto plane while holding the bow of the boat down. When the boat reaches planing speed, the tabs are automatically raised to minimize forward drag on the boat. The helmsman is then free to adjust the attitude of the boat, bow to stern and port to starboard as loading conditions dictate. When the boat goes off-plane, the automatic trim tab control is again invoked to keep the bow down, and to brake the motion of the boat.

In accordance with these and other aspects and attributes of the present invention, the invention should be perceived broadly, in accordance with the following claims only, and not solely in accordance with those particular embodiments within which the invention has been taught.

What is claimed is:

1. An automated system for controlling the position of the trim tabs of a vessel comprising:

speed sensor means for sensing the speed of the vessel through the water; and control means responsive to the speed sensed by the speed sensor means for positioning the vessel's trim tabs to an up position at such times as the sensed speed increases above a first predetermined value.

2. The automated trim tab control system according to claim 1 wherein the control means is further for positioning the vessel's trim tabs to a down position at such times as the sensed speed decreases below a second predetermined value, less than the first predetermined value.

3. The automated trim tab control system according to claim 2 wherein the control means is positioning the vessel's trim tabs to their full down position at such times as the sensed speed decreases below the second predetermined value.

4. The automated trim tab control system according to claim 1 wherein the control means is positioning the vessel's trim tabs to their full up position at such times as the sensed speed increases above the first predetermined value.

5. The automated trim tab control system according to claim 1 for use on a power boat having an engine, the system further comprising:

performance sensor means for sensing the over-the-water performance of the power boat; and wherein the control means further comprises:

perturbation means, operative at a time after the trim tabs have been positioned to the up position, controllable for, from time to time, slightly varying the trim tabs in position about their current up position; and comparison means, responsive to the trim tab positional variations of the perturbation means and to the sensed performance of the performance sensor means, for controlling the perturbation means to vary the trim tabs in position in order that the sensed performance should be maximized.

6. The automated trim tab control system according to claim 5 wherein the performance sensor means comprises:

tachometer means for sensing the revolutions per unit time of the engine of the power boat; and wherein the comparison means is for controlling the perturbation means to vary the trim tabs in position in order that the sensed revolutions per unit time should be maximized.

7. The automated trim tab control system according to claim 6 wherein the perturbation means is slightly varying the trim tabs in position for a predetermined time duration.

8. The automated trim tab control system according to claim 7 wherein the perturbation means is slightly varying the trim tabs in position for the predetermined time duration that is greater than a predetermined settling time duration that it takes for the currently perturbed trim tab position to cease to significantly further affect any change in the revolutions per unit time of the boat's engine that is sensed by the tachometer means.

9. The automated trim tab control system according to claim 6 wherein the perturbation means is controllable for varying the trim tabs unidirectionally only in the downwards direction from the initial up position of the trim tabs until, the revolutions per unit time that are sensed by the tachometer means having been sensed to have decreased from a value that was sensed at an immediately preceding time interval, the perturbation means varies the trim tabs slightly upwards but one time only, and is thereafter inoperative to vary the trim tabs in position for an extended time interval.

10. The automated trim tab control system according to claim 9 wherein the extended time interval during which the perturbation means is inoperative for further slightly varying the trim tabs in position is of a longer duration than the predetermined settling time duration.

11. The automated trim tab control system according to claim 9 wherein the performance sensor means comprises:

speedometer means for sensing the speed over the water of the power boat; and wherein the extended time interval during which the perturbation means is inoperative for further slightly varying the trim tabs in position is for an extended time interval until such time as the boat's speed as is sensed by the speedometer means decreases below a predetermined value, a control of the boat's trim tabs reverting to manual during this extended time interval.

12. The automated trim tab control system according to claim 5 wherein the performance sensor means comprises:

speedometer means for sensing the speed over the water of the power boat; and wherein the comparison means is for controlling the perturbation means to vary the trim tabs in position in order that the sensed speed should be maximized.

13. The automated trim tab control system according to claim 1 for use on a power boat having dual engines, the system further comprising:

tachometer means for sensing the revolutions per unit time of each of the dual engines of the power boat; and synchronization means responsive to the sensed revolutions per unit time of each of the two engines for adjusting the throttle of a one engine until its sensed revolutions per unit time equals the sensed revolutions per unit time of the other engine; and wherein the control means further comprises:

perturbation means, operative at a time after the trim tabs have been positioned to the up position and the two engines have been synchronized in speed, controllable for, from time to time, slightly varying the trim tabs upwards or downwards, as the case may be, in position about their current up position; and comparison means, responsive to the trim tab positional variations of the perturbation means and to the sensed revolutions per unit time of the tachometer means, for controlling the perturbation means to vary the trim tab position upwards or downwards, as the case may be, in order that the sensed revolutions per unit time should be maximized.

14. The automated trim tab control system according to claim 13 further comprising:

means for disabling that the control means should further position the trim tabs after once the sensed revolutions per unit time have been maximized, the control of the boat's trim tabs thereafter reverting to manual.

15. The automated trim tab control system according to claim 1 further comprising:

means for disabling that the control means should further position the trim tabs after once they have assumed the up position, the control of the boat's trim tabs thereafter reverting to manual.

16. The automated trim tab control system according to claim 1 further comprising:

means for disabling that the control means should further position the trim tabs after once they have assumed the down position, the control of the boat's trim tabs thereafter reverting to manual.

17. An automated method of controlling the position of the trim tabs of a vessel comprising:

electronically sensing with electronic circuitry the speed of the vessel through the water; and positioning with a mechanical mechanism responsive to the speed electronically sensed the vessel's trim tabs to an up position at such time as the sensed speed increases above a first predetermined value.

18. An automated trim tab positional control method of controlling the position of the trim tabs of a vessel comprising:

sensing the speed of the vessel through the water; positioning responsively to the speed sensed the vessel's trim tabs to an up position at such time as the sensed speed increases above a first predetermined value; and further positioning the vessel's trim tabs to a down position at such times as the sensed speed decreases below a second predetermined value, less than the first predetermined value.

19. A method of automated trim tab control for use on a power boat having an engine and trim tabs, the method comprising:

sensing the over-the-water performance cf the power boat;

perturbing, at a time after the boat's trim tabs have been positioned to the up position, the trim tabs slightly in position about their current position;

comparing the sensed performance of the boat at times before and after the trim tabs are perturbed in position in order to determine whether the boat's performance has been improved, or has been diminished as the case may be, by a most recent positional perturbation of the trim tabs; and adjusting the trim tabs in position in accordance with the determination resultant from the comparing in order that the sensed performance of the boat should be maximized.

20. The automated trim tab control method according to claim 19 wherein the sensing comprises:

sensing the revolutions per unit time of the engine of the power boat;

wherein the adjusting of the trim tabs in position is in order that the sensed revolutions per unit time should be maximized.

21. The automated trim tab control system according to claim 20 wherein the sensing comprises:

sensing the speed over the water of the power boat;

wherein the adjusting of the trim tabs in position is in order that the sensed speed should be maximized.

* * * * *